US006527513B1

(12) United States Patent
Van Drentham-Susman et al.

(10) Patent No.: US 6,527,513 B1
(45) Date of Patent: Mar. 4, 2003

(54) TURBINE FOR DOWN-HOLE DRILLING

(75) Inventors: Hector F.A. Van Drentham-Susman, Inverurie (GB); Kenneth Roderick Stewart, Aberdeen (GB)

(73) Assignee: Rotech Holdings Limited, Aberdeen (GB)

( * ) Notice: Subject to any disclaimer, the term of this patent is extended or adjusted under 35 U.S.C. 154(b) by 0 days.

(21) Appl. No.: 09/773,698

(22) Filed: Jan. 31, 2001

Related U.S. Application Data

(63) Continuation-in-part of application No. PCT/GB99/02450, filed on Jul. 27, 1999.

(30) Foreign Application Priority Data

Jul. 31, 1998 (GB) ..... 9816607

(51) Int. Cl.[7] ..... F04D 13/10
(52) U.S. Cl. ..... 415/202; 415/903
(58) Field of Search ..... 415/202, 203, 415/903, 904

(56) References Cited

U.S. PATENT DOCUMENTS 2,371,248 A * 3/1945 McNamara ..... 173/64
2,750,154 A * 6/1956 Boice ..... 173/205
3,966,369 A * 6/1976 Garrison ..... 418/149
5,098,258 A * 3/1992 Barnetche-Gonzales . 415/182.1

* cited by examiner

*Primary Examiner*—Edward K. Look
*Assistant Examiner*—Ninh Nguyen
(74) *Attorney, Agent, or Firm*—John R Casperson

(57) ABSTRACT

A turbine (4) suitable for use in down-hole drilling and the like, and comprising a tubular casing (11) enclosing a chamber (18) having rotatably mounted therein a rotor (19). The rotor (19) comprises at least one turbine wheel blade arrays **(30*a*) with an annular array of angularly distributed blades (30), and a generally axially extending inner drive fluid passage (14) generally radially inwardly of said rotor (19). The casing (11) also has respective generally axially extending outer drive fluid passage (16) associated with said at least one turbine wheel blade array (30*a*), and one of the inner and the outer drive fluid passages (14, 16) constitute a drive fluid supply passage and is provided with outlet nozzles (17) formed and arranged for directing at least one jet of drive fluid onto the blade drive fluid receiving faces (31) for imparting rotary drive to said rotor (19). The other of the inner and the outer drive fluid passages (14, 16) constitutes a drive fluid exhaust passage and is provided with exhaust aperture (28) for exhausting drive fluid from the turbine (4)**.

24 Claims, 4 Drawing Sheets

TURBINE FOR DOWN-HOLE DRILLING

CROSS REFERENCES TO RELATED APPLICATIONS

This application is a continuation in part of copending application serial number PCT/GB99/02450 titled "Drilling Turbine" which designated the United States and had an international filing date of Jul. 27, 1999. Demand was timely filed. Application serial number PCT/GB99/02450 had an international publication number of WO 00/08293, an international publication date of Feb. 17, 2000, and a priority date of Jul. 31, 1998 from GB 9816607.7.

The present invention relates to turbines suitable for down-hole applications such as bore-hole drilling and driving various down-hole tools.

Conventional turbines for down-hole use generally comprise a longitudinally extending turbine stage array in which the drive fluid passes substantially axially through a multiplicity of turbine stages connected in series. Particular disadvantages of this type of arrangement include relatively low efficiency due to the rapid increase of efficiency losses with increasing number of turbine stages, and the considerable length required to achieve any useful torque levels. Typical commercially available turbines of this type having of the order of 100 to 200 turbine stages, have a length of around 20 m and longer. Such a length presents considerable restrictions on the use of such turbines in non-rectilinear drilling e.g. directional drilling situations, because of restrictions on minimum radius of curvature of kick-off which can be used, as well as in drilling operations using coiled tubing because of the large lubricators required to accommodate the turbine together with the drilling tools and other equipment required. This in turn gives rise to substantial practical problems in the positioning of the injector at a suitable height, above the lubricator.

It is an object of the present invention to avoid or minimise one or more of the above disadvantages and/or problems.

It has now been found that a compact, high power, turbine can be achieved by means of a combined redial impulse and drag turbine in which substantially increased turbine drive output is obtained within a given length of turbine.

The present invention provides a turbine suitable for use in down-hole drilling and the like, and comprising a tubular casing enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending inner drive fluid passage generally radially inwardly of said rotor, said casing having a generally axially extending outer drive fluid passage, one of said inner and outer drive fluid passages constituting a drive fluid supply passage and being provided with at least one outlet nozzle formed and arranged for directing at least one jet of drive fluid onto said blade drive fluid receiving faces of said at least one blade array as said blades traverse said nozzle for imparting rotary drive to said rotor, the other constituting a drive fluid exhaust passage and being provided with at least one exhaust aperture for exhausting drive fluid from said at least one turbine wheel blade array.

Preferably the turbine has a plurality, advantageously, a multiplicity, of said turbine wheel means disposed in an array of parallel turbine wheels extending longitudinally along the central rotational axis of the turbine with respective parallel drive fluid supply jets.

In a particularly preferred aspect the present invention provides a turbine suitable for use in down-hole drilling and the like, and comprising a tubular casing enclosing a chamber having rotatably mounted therein a rotor having at least two turbine wheel blade arrays each with an annular array of angularly distributed blades orientated with drive fluid receiving faces thereof facing generally rearwardly of a forward direction of rotation of the rotor, and a generally axially extending inner drive fluid passage generally radially inwardly of each said turbine wheel blade array, said casing having a respective generally axially extending outer drive fluid passage associated with each said turbine wheel blade array, one of said inner and outer drive fluid passages constituting a drive fluid supply passage and being provided with at least one outlet nozzle formed and arranged for directing at least one jet of drive fluid onto said blade drive fluid receiving faces as said blades traverse said at least one nozzle for imparting rotary drive to said rotor, the other constituting a drive fluid exhaust passage and being provided with at least one exhaust aperture for exhausting drive fluid from said turbine wheel blade arrays, neighbouring turbine wheel blade arrays being axially spaced apart from each other and provided with drive fluid return flow passages therebetween connecting the exhaust passage of an upstream turbine wheel blade array to the supply passage of a downstream turbine wheel blade array for serial interconnection of said turbine wheel blade arrays.

Instead of, or in addition to providing a said inner or outer drive fluid passage for exhausting of drive fluid from the chamber, there could be provided exhaust apertures in axial end wall means of chamber, though such an arrangement would generally be less preferred due to the difficulties in manufacture and sealing.

In yet another variant of the present invention, both the drive fluid supply and exhaust passage means could be provided in the casing (i.e. radially outwardly of the rotor) with drive fluid entering the chamber from the supply passage via nozzle means to impact the turbine blade means and drive them forward, and then exhausting from the chamber via outlet apertures angularly spaced from the nozzle means in a downstream direction, into the exhaust passages.

Thus essentially the turbine of the present invention is of a radial (as opposed to axial) flow nature with motive fluid moves between radially (as opposed to axially) spaced apart positions to drive the turbine blade means. This enables the performance, in terms of torque and power characteristics, of the turbines of the present invention to be readily varied by simply changing the nozzle size—without at the same time having to redesign and replace all the turbine blades as is generally the case with conventional axial flow turbines when any changes in fluid velocity and/or fluid density are made. Thus, for example, reducing the nozzle size will (assuming constant flow rate) increase the (fluid jet) flow velocity thereby increasing torque. This will also increase the operating speed of the turbine and thereby the power, as well as increasing back pressure. Similarly increasing flow rate while keeping nozzle size constant will also increase the (fluid jet) flow velocity thereby increasing torque as well as giving an increase in the operating speed of the turbine and thereby the power and increasing back pressure. Alternatively, increasing the nozzle size while keeping the (fluid jet) flow velocity constant—by increasing the flow rate, would increase torque and power without increasing the turbine speed or back pressure. If desired, torque can also be increased by increasing the density of the drive fluid (assuming constant fluid flow rate and velocity) which increases the flow mass.

It will be appreciated that individual nozzle size can be increased longitudinally and/or angularly of the turbine, and that the number of nozzles for the or each turbine wheel blade array can also be varied.

The turbine blades can also have their axial extent longitudinally of the turbine increased so as to increase the parallel mass flow of motive fluid through the or each turbine wheel array, without suffering the severe losses encountered with conventional multi-stage turbines comprising axially extending arrays of axially driven serially connected turbine blade arrays.

Another advantage of the turbines of the present invention that may be mentioned is the circumferential fluid velocity distribution over the turbine blades is, due to the generally radial disposition of the said blades, substantially constant and thus very efficient in comparison with an axial turbine where the velocity distribution varies over the length of the blade and thus losses are caused through hydrodynamic miss-match of fluid velocity and circumferential blade velocity.

The turbines of the present invention also have some significant advantages over positive displacement motors in that they can use relatively viscous and/or dense drive fluids such as more or less heavily weighted drilling muds e.g. high density drilling muds weighted with bentonite or barytes, which are required, for example, for high pressure wells.

Another important advantage over conventional turbines for down-hole use is that the motors of the present invention are substantially shorter for a given output power (even when taking into account any gear boxes which may be required for a given practical application). Typically a conventional turbine may have a length of the order of 15 to 20 meters, whilst a comparable turbine of the present invention would have a length of only 2 to 3 meters for a similar output power. This has very considerable benefits such as reduced manufacturing costs, easier handling, and smaller radius borehole deviation negotiation ability.

Yet another advantage that may be mentioned is that the relatively high overall efficiency of turbines of the present invention allows the use of smaller size (diameter) turbines than has previously been possible. With conventional down-hole turbines, the so called "slot losses" which occur due to drive fluid leakage between the tips of the turbine blades and the casing due to the need for a finite clearance therebetween, become proportionately greater with reduced turbine diameter. In practice this results in a minimum effective diameter for a conventional turbine of the order of around 10 cm. With the increased overall efficiency of the turbines of the present invention it becomes practical significantly to reduce the turbine diameter, possibly as low as 3 cm.

In one, preferred, form of the invention the outer passage means serves to supply the drive fluid to the turbine wheel means via nozzle means, preferably formed and arranged so as to project a drive fluid jet generally tangentially of the turbine wheel means, and the inner passage means serves to exhaust drive fluid from the chamber, with the inner passage means conveniently being formed in a central portion of the rotor. In another form of the invention the inner passage means is used to supply the drive fluid to blade means mounted on a generally annular turbine wheel means. In this case the nozzle means are generally formed and arranged to project a drive fluid jet more or less radially outwardly, and the blade means drive fluid receiving face will tend to be oriented obliquely of a radial direction so as to provide a forward driving force component as the jet impinges upon said face.

In principle there could be used just a single nozzle means. Generally though there is used a plurality of angularly distributed nozzle means e.g. 2, 3 or 4 at 180°, 120° or 90° intervals, respectively. In the preferred form of the invention, the nozzle means are preferably formed and arranged to direct drive fluid substantially tangentially relative to the blade means path, but may instead be inclined to a greater or lesser extent radially inwardly or outwardly of a tangential direction e.g. at an angle from +5° (outwardly) to −20° (inwardly), preferably 0° to −10°, relative to the tangential direction—corresponding to from 95 to 70°, preferably 90 to 80°, relative to a radially inward direction.

As noted above the power of the motor may be increased by increasing the motive fluid energy transfer capacity of the turbine, in parallel—e.g. by having larger cross-sectional area and/or more densely angularly distributed nozzles. The driven capacity of the turbine may be increased by inter alia increasing the angular extent of the nozzle means in terms of the size of individual nozzle means around the casing, and/or by increasing the longitudinal extent of the nozzle means in terms of longitudinally extended and/or increased numbers of longitudinally distributed nozzle means. In general though the outlet size of individual nozzle means should be restricted relative to that of the drive fluid supply passage, in generally known and calculable manner, so as to provide a relative high speed jet flow. The jet flow velocity is generally around twice the linear velocity of the turbine (at the fluid jet flow receiving blade portion) (see for example standard text books such as "Fundamentals of Fluid Mechanics" by Bruce R Munson et al published by John Wiley & Sons Inc). Typically, with a 3.125 inch (8 cm) diameter turbine of the invention there would be used a nozzle diameter of the order of from 0.1 to 0.35 inches (0.25 to 0.89 cm).

The size of the blade means including in particular the longitudinal extent of individual blade means and/or the number of longitudinally distributed blade means, will generally be matched to that of the nozzle means. Preferably the blade means and support therefor are formed and arranged so that the unsupported length of blade means between axially successive supports is minimised whereby the possibility of deformation of the blade means by the drive fluid jetting there onto is minimised, and in order that the thickness of the blade means walls may be minimised. The number of angularly distributed individual blade means may also be varied, though the main effect of an increased number is in relation to smoothing the driving force provided by the turbine. Preferably there is used a multiplicity of more or less closely spaced angularly distributed blade means, conveniently at least 6 or 8, advantageously at least 9 or 12 angularly distributed blade means, for example from 12 to 24, conveniently from 15 to 21, angularly distributed blade means.

It will also be appreciated that various forms of blade means may be used. Thus there may be used more or less planar blade means. Preferably though there is used a blade means having a concave drive fluid receiving face, such a blade means being conveniently referred to hereinafter as a bucket means. The bucket means may have various forms of profile, and may have open sides (at each longitudinal end thereof). Conveniently the buckets are of generally part cylindrical channel section profile (which may be formed from cylindrical tubing section). Optimally, however, the bucket should be aerodynamically/hydrodynamically shaped to prevent detachment of the boundary layer and to produce a less turbulent flow through the turbine blade array and thus reduce parasitic pressure drop across the blade array.

Various forms of blade support means may be used in accordance with the present invention. Thus, for example, the support means may be in the form of a generally annular structure with longitudinally spaced apart portions between which the blade means extend. Alternatively there may be used a central support member, conveniently in the form of a tube providing the inner drive fluid passage means, with exhaust apertures therein through which used drive fluid from the chamber is exhausted, the central support member having radially outwardly projecting and axially spaced apart flanges or fingers across which the blade means are supported. Alternatively the blade means may have root portions connected directly to the central support member.

The turbines of the present invention may typically have normal running speeds of the order of 3,000 to 10,000, for example, from 5,000 to 8,000, rpm. In order to increase torque they are preferably used with gear box means. In general there may be used gear box means providing at least 5:1, preferably at least 10:1, speed reduction. Conveniently there is used a serially interconnected array of epicyclic gear boxes each having a gearing ratio of the order of 3:1 to 4:1, for example 2 gear boxes each having a ratio of 3:1 would provide an overall ratio of 9:1. Preferably there is used an epicyclic gear box with typically 3 or 4 planet wheels mounted in a rotating cage support used to provide an output drive in the same sense as the input drive to the sun wheel, usually clockwise, so that the output drive is also clockwise. Preferably there is used a ruggedised gear box means with a substantially sealed boundary lubrication system, advantageously with a pressure equalisation system for minimizing ingress of drilling mud or other material from the borehole into the gear box interior.

In a further aspect the present invention provides a turbine drive system suitable for use in downhole drilling and the like comprising at least one turbine of the invention drivingly connected to at least one reducing gearbox.

In yet another aspect the present invention provides a bottom hole assembly comprising at least one turbine of the invention drivingly connected to a tool, preferably via at least one reducing gearbox.

In a still further aspect the present invention provides a drilling apparatus comprising a drill string, preferably comprising coiled tubing, and a bottom hole assembly of the invention wherein the tool comprises a drill bit.

Further preferred features and advantages of the invention will appear from the following detailed description given by way of example of some preferred embodiments illustrated with reference to the accompanying drawings in which:

FIGS. 8–12 show another preferred embodiment in which: FIG. 8 is a longitudinal section corresponding generally to that of FIG. 2;

FIGS. 9 and 10 are transverse sections in the planes $\overline{\text{IX}}$—$\overline{\text{IX}}$ and $\overline{\text{X}}$—$\overline{\text{X}}$ indicated in FIG. 8;

FIG. 11 is a perspective view showing the principal parts of the turbine of FIGS. 8–10 with the outer casing removed; and FIG. 12 is a corresponding view with part of the stator removed to reveal the rotor.

Figure 1:
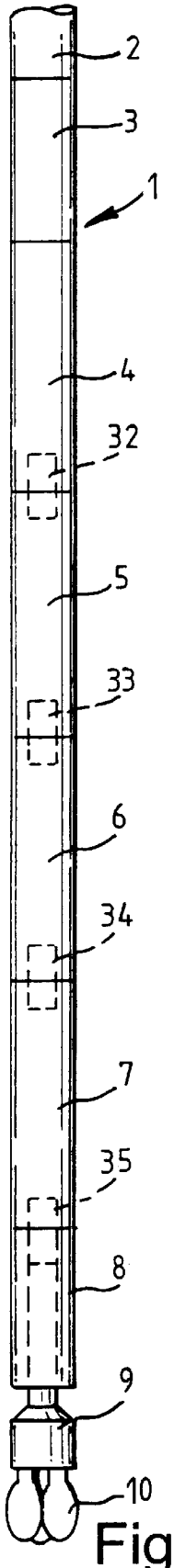
FIG. 1 is schematic side elevation of the downhole components of a drilling apparatus with a turbine drive system of the present invention.
Figure 2:
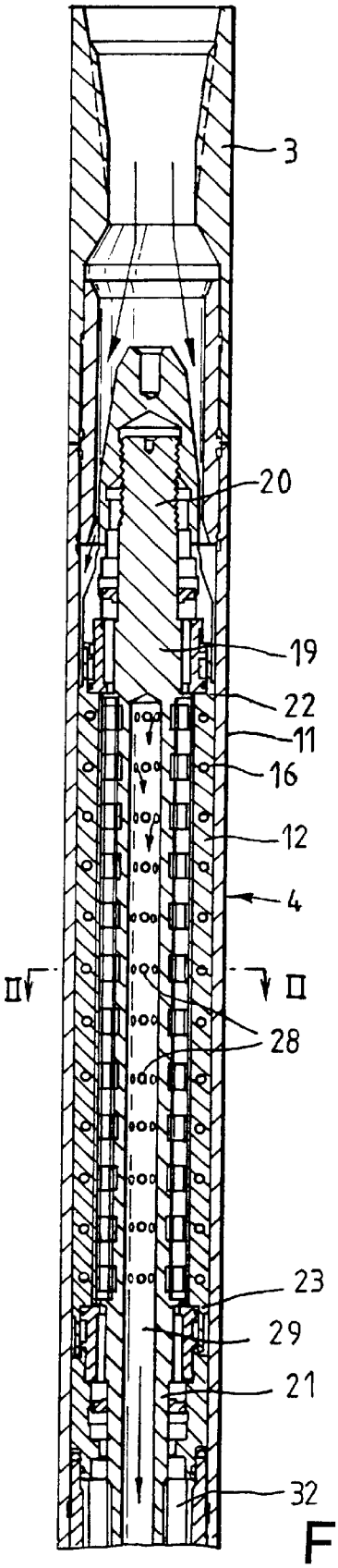
FIG. 2 is a longitudinal section of part of the downhole drive system of the apparatus of FIG. 1 showing one of the turbine power units therein (including FIG. 2A which is a transverse section of the turbine unit) but with bearing and seal details omitted for greater clarity)
Figure 2A:
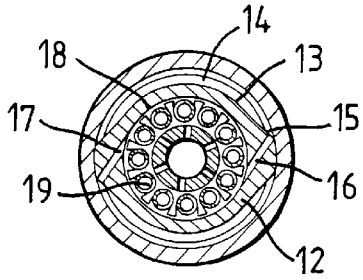
Figure 7:
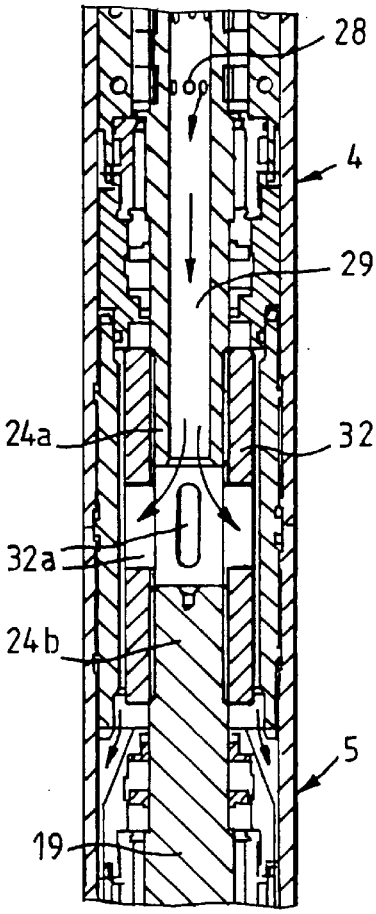
FIG. 7 is a detail view showing the connection between the upper and lower turbine units.

FIG. 1 shows the downhole end of a borehole drilling apparatus drill string comprising a bottom-hole assembly 1 connected to a coiled tubing drilling pipe 2. The principal parts of the assembly 1 are, in order, a top sub 3, an upper turbine 4, a lower turbine 5, an upper gear box 6, a lower gear box 7, a bearing pack 8, a bottom sub 9, and a drill bit 10. As shown in more detail in FIG. 2, the upper turbine 4 comprises an outer casing 11 in which is fixedly mounted a stator 12 having a generally lozenge-section outer profile 13 defining with the outer casing 11 two diametrically opposed generally semi-annular drive fluid supply passages 14 therebetween. At the clockwise end 15 of each passage 14 is provided a conduit 16 providing a drive fluid supply nozzle 17 directed generally tangentially of a cylindrical profile chamber 18 defined by the stator 12 inside which is disposed a rotor 19.

Figure 3:
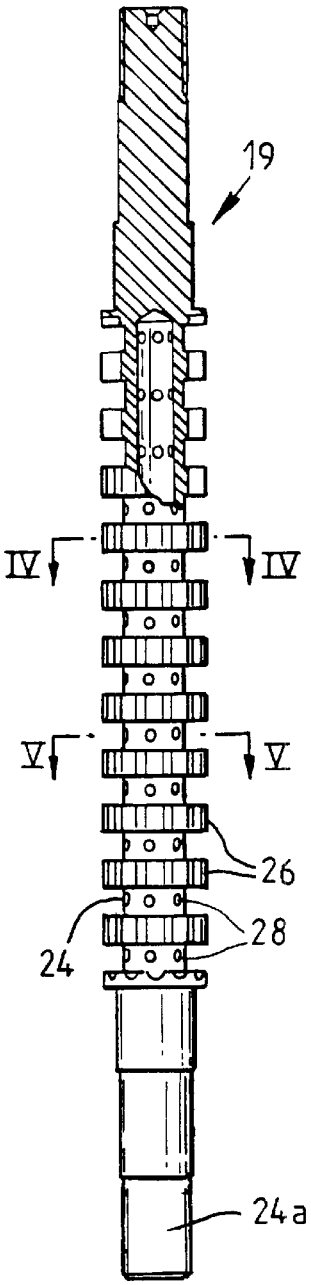
FIG. 3 is a partly sectioned side elevation of the main part of the turbine rotor without the bucket means.
Figure 4:
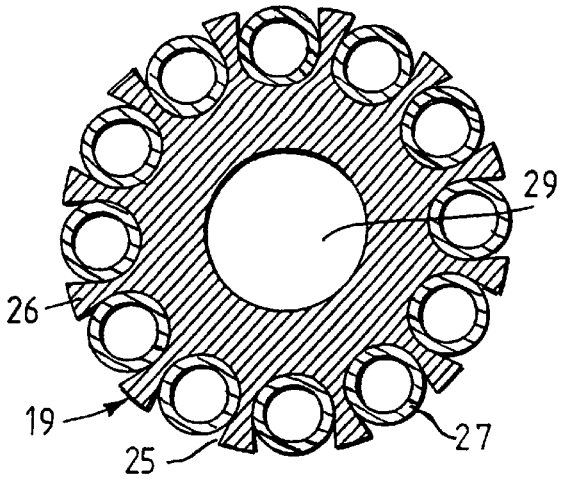
FIGS. 4 and 5 are transverse sections of the rotor of FIG. 3 but with the bucket means in place.
Figure 5:
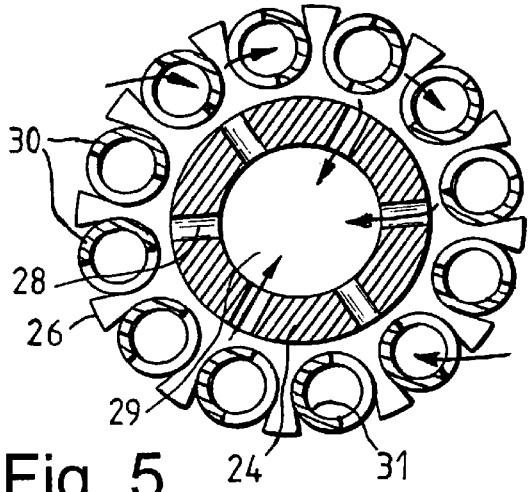

The rotor 19 is mounted rotatably via suitable bushings and bearings (not shown) at end portions 20,21 which project outwardly of each end 22,23 of the stator 12. As shown in FIGS. 3 to 5, the rotor 19 comprises a tubular central member 24 which is closed at the upper end portion 20 and, between the end portions 20,21, has a series of spaced apart radially inwardly slotted 25 flanges 26 in which are fixedly mounted cylindrical tubes 27 (see FIGS. 4 & 5) extending longitudinally of the rotor. FIG. 4 is a transverse section through a flange 26 which supports the base and sides of the tubes 27 thereat. FIG. 5 is a transverse section of the rotor 19 between successive flanges 26 and shows a series of angularly spaced exhaust apertures 28 extending radially inwardly through the tubular central member 24 to a central axial drive fluid exhaust passage 29. Between the flanges 26, the tubes 27 are cut-away to provide angularly spaced apart series of semi-circular channel section buckets 30 forming, in effect, a series of turbine wheels 30*a* interspersed by supporting flanges 26. The buckets 30 are oriented so that their concave inner drive fluid receiving faces 31 face anti-clockwise and rearwardly of the normal clockwise direction of rotation of the turbine rotor 19 in use of the turbine. The buckets 30 are disposed substantially clear of the central tubular member 24 so that drive fluid received thereby can flow freely out of the buckets 30 and eventually out of the exhaust apertures 28. With the rotor 19 being enclosed by the stator 12 it will be appreciated that in addition to the "impulse" driving force applied to a bucket 30 directly opposite a nozzle 17 by a jet of drive fluid emerging therefrom, other buckets will also receive a "drag" driving force from the rotating flow of drive fluid around the interior of the chamber 18 before it is exhausted via the exhaust apertures 28 and passage 29.

Figure 6:
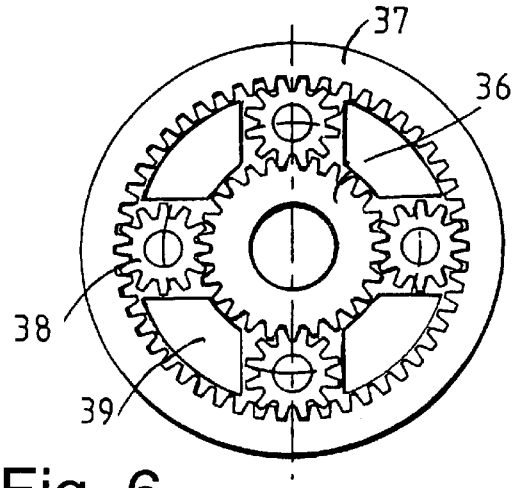
FIG. 6 is a transverse section of an epicyclic gear system used in the apparatus of FIG. 1.

The rotor 19 of the upper turbine 4 is drivingly connected via a hexagonal (or similar) coupling 32 to the rotor of the lower turbine 5 which is substantially similar to the upper turbine 4 and is in turn drivingly connected via the upper and lower gear boxes 6,7 and suitable couplings 33,34,35 to the bottom sub 9 which has mounted therein a drill bit 10. As shown in FIG. 6 the gear boxes 6,7 are of epicyclic type with a driven sun wheel 36, a fixed annulus 37, and 4 planet wheels 38 mounted in a cage 39 which provides an output drive in the same direction as the direction of rotation of the driven sun wheel 36.

In use of the apparatus, the motive fluid enters the top sub 3 and passes down into the semi-annular supply passages 14 of the upper turbine 4 between the outer casing 11 and stator 12 thereof, whence it is jetted via the nozzles 17 into the chamber 18 in which the rotor 19 is mounted so as to impact in the buckets 30 thereof. The motive fluid is exhausted out of the chamber 18 via the exhaust apertures 28 down the central exhaust passage 29 inside the central rotor member 24 until it reaches the lower end 24*a* thereof engaged in the hexagonal coupling 32, drivingly connecting it to the closed upper end 24*b* of the rotor 19 of the lower turbine 5. The fluid then passes radially outwards out of apertures 32*a* provided in the hexagonal coupling 32 of the lower turbine and then passes along into the semi-annular supply passages 14 of the lower turbine 5 between the outer casing 11 and stator 12 thereof to drive the lower turbine 5 in the same way as the upper turbine 4. It will be appreciated that the lower turbine is effectively driven in series with the upper turbine. This is though quite effective and efficient given the highly efficient "parallel" driving within each of the upper and lower turbines. The drilling mud motive fluid exhausted from the lower turbine then passes along central passages extending through the interior of the gear boxes 6,7, and bottom sub 9 whose upper end extends through the interior of the bearing pack 8, to emerge at the drill bit 10 in the usual way.

With a single turbine unit as shown in the drawings suitable for use in a 3.125 inch (8 cm) diameter bottom hole assembly and a drive fluid supply pressure of 70 kg/cm$^2$ there may be obtained an output torque of the order of 2.5 m.kg at 6000 rpm. With a 3:1 ratio gearing down there can then be obtained an output torque of the order of 8 m.kg at 2000 rpm. With a system as illustrated there can be obtained an output torque of the order of 25 m.kg at 600 rpm which is comparable with the performance of a similarly sized conventional Moineau motor or conventional downhole turbine having a diameter of 4 ¾" (12 cm) and 50 ft (15.24 m) length.

It will be appreciated that various modifications may be made to the abovedescribed embodiments without departing from the scope of the present invention. Thus for example the profiles of the buckets 30 and their orientation, and the configuration and orientation of the nozzles 17, may all be modified so as to improve the efficiency of the turbine.

The embodiment of FIGS. 8–12 is generally similar to that of FIGS. 2–5, comprising an outer casing 41 in which is fixedly mounted a stator 42 having a generally lozenge-section outer profile 43 defining with the outer casing 41 four angularly distributed generally segment-shaped drive fluid supply passages 44 therebetween. At the clockwise end 45 of each passage 44 is provided a drive fluid supply conduit 46 providing a drive fluid supply nozzle 47 directed generally tangentially of a cylindrical profile chamber 48 defined by the stator 42 inside which is disposed a rotor 49.

Figure 9:
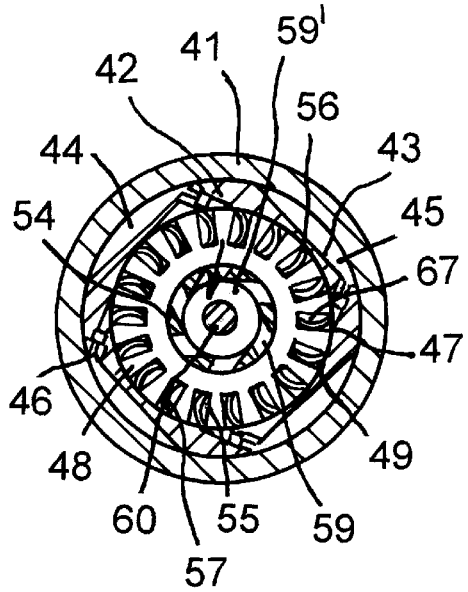
Figure 10:
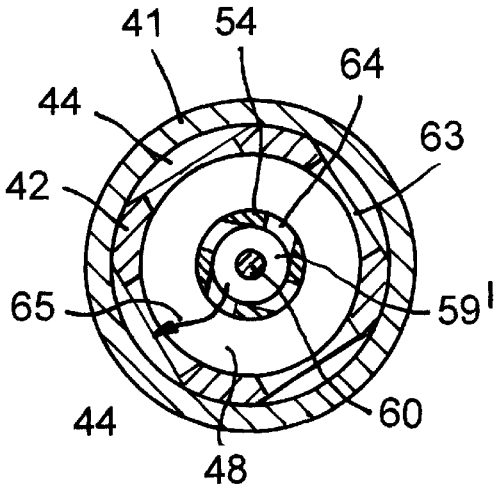
Figures 11, 12:
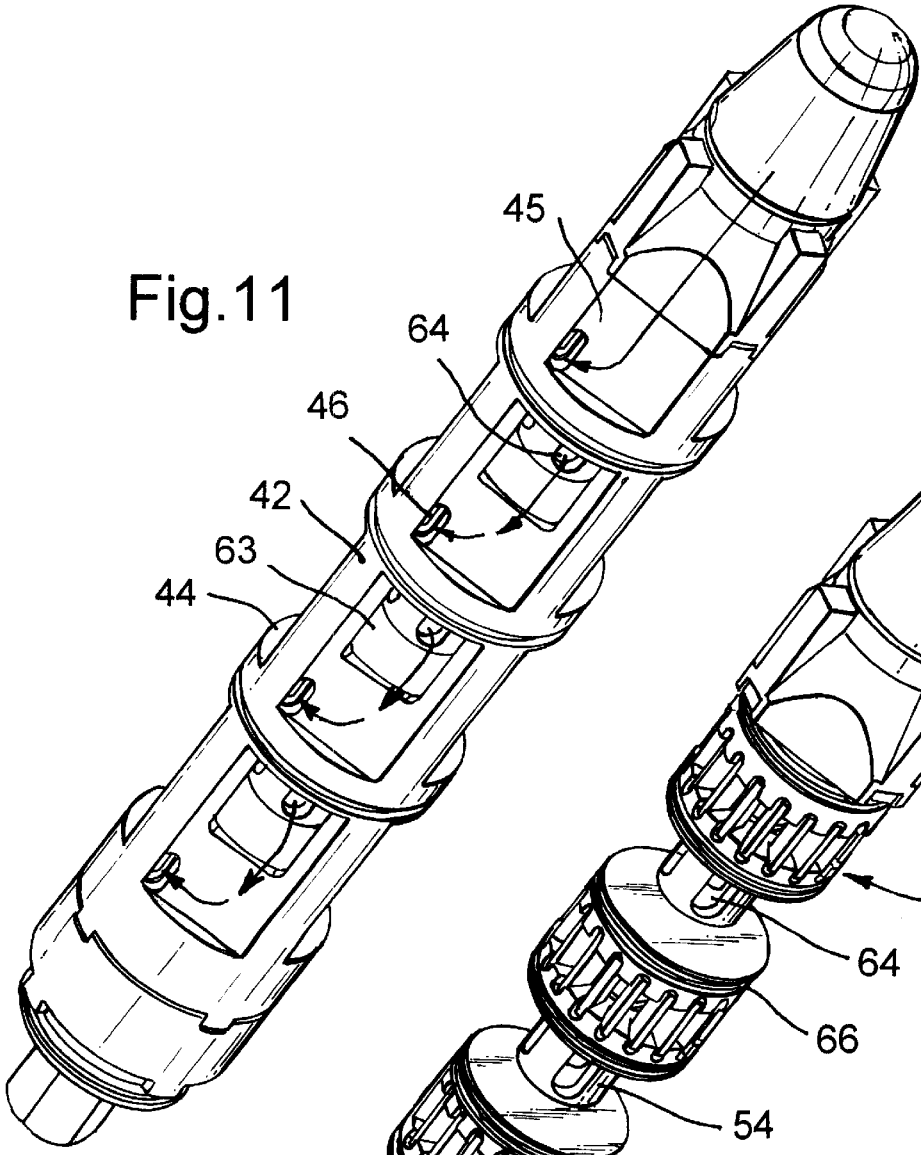

The rotor 49 is mounted rotatably via suitable bushings and bearings 50, 51 at the end portions 52*a*, 52*b* which project outwardly of each end 53*a*, 53*b* of the stator 42. As shown in FIGS. 9, 10 and 12 the rotor 49 comprises an elongate tubular central member 54 which has a series of axially spaced apart radially inwardly slotted 55 flanges 56 in which are fixedly mounted four axially spaced apart sets of cylindrical tube profile or aerodynamically/hydrodynamically shaped turbine blades 57 providing an array of four turbine wheel blade arrays 58A–D extending longitudinally along the central rotational axis of the rotor 49. FIG. 9 is a transverse section through a turbine wheel blade array 58A and shows four nozzles 47 for directing jets of drive fluid into the blades 57 and a series of six angularly spaced apart exhaust apertures 59' extending radially inwardly through the tubular central member 54 to an inner drive fluid exhaust passage 59. Inside the tubular central member 54 is provided a spindle member 60 mounting a series of annular sealing members 61A–C for isolating lengths of inner drive fluid exhaust passage 59' A–C, from each other. A further length of inner drive fluid exhaust passage 59'D is isolated from the preceding length 59'C by an integrally formed end wall 62.

Between the opposed flanges 56', 56" of each pair of successive turbine wheel blade arrays 58A–D, the stator 42 is provided with relatively large apertures 63 which together with apertures 64 in the tubular central member 54 provide drive fluid return flow passages 65 for conducting drive fluid exhausted from the exhaust apertures 59 of an upstream turbine wheel blade array 58A into the respective inner drive fluid exhaust passage 59', to the drive fluid supply passage 44 of a turbine wheel blade array 58B immediately downstream thereof for serial interconnection of said turbine wheel blade arrays 58A, 58B. As shown in FIG. 10, the apertures 64 in the tubular central member 54 are orientated generally tangentially in order to improve fluid flow efficiency.

As may be seen from the drawings, the drive fluid supply conduit 46 are in the form of relatively large slots having an axial extent almost equal to that of the turbine blades 57 so that the fluid flow capacity and power of each turbine wheel blade array 58A etc is actually similar to that of each of the (serially interconnected—see FIG. 2B) turbine units 4, 5, with its series of 12 turbine wheel blade arrays connected in parallel (as illustrated in FIG. 3) of the first described embodiment.

In order to isolate the drive fluid supply passages 44 of successive turbine wheel blade arrays 58A, 58B etc from each other, the flanges 56 supporting the turbine blades 57 are provided with low-friction labyrinth seals 66 around their circumference.

Figure 8:
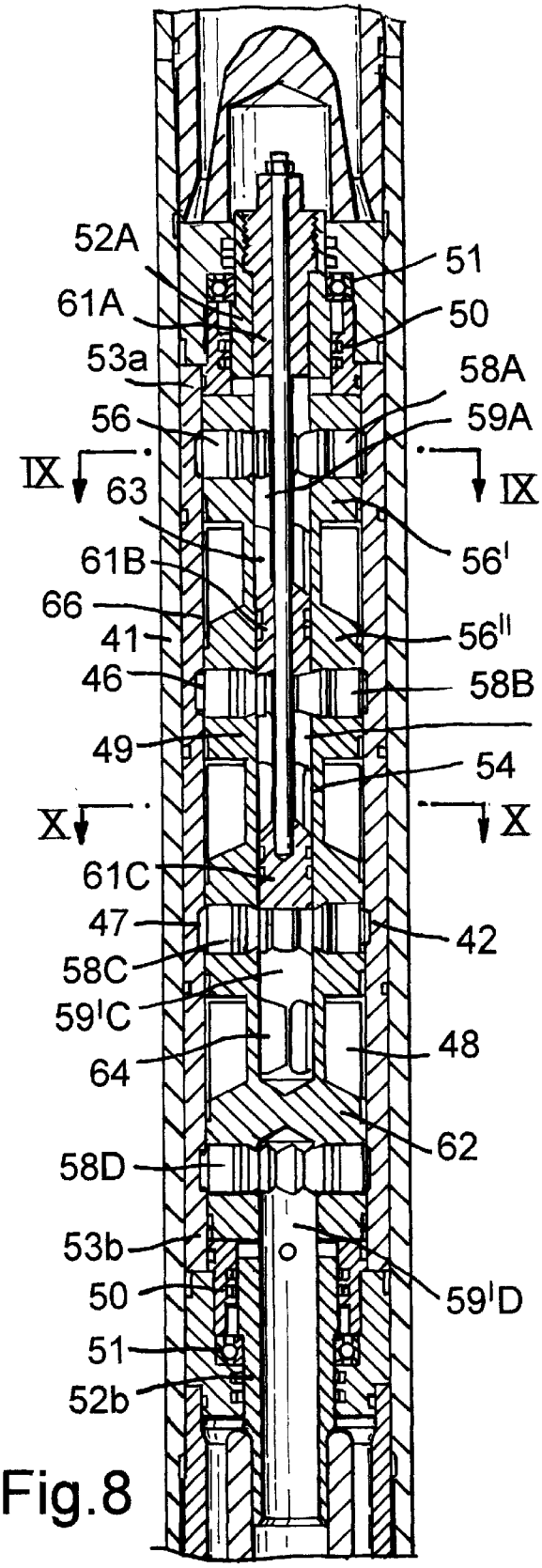

As will be apparent from FIG. 8, the close and compact coupling and arrangement of the four turbine wheel blade arrays 58A–D, requires a much smaller amount of bearings and seals thereby considerably reducing frictional losses as compared with the type of arrangement illustrated in FIGS. 23, as well as considerably reduced length, thereby providing a much higher torque and power output for a given length and size of turbine, as compared with previously known turbines.

In other respects the turbine of FIGS. 8–12 is generally similar to that of FIGS. 2–5. Thus the turbine blades 57 form concave buckets 67 oriented so that their concave inner drive fluid receiving faces 68 face anti-clockwise and rearwardly of the normal clockwise direction of rotation of the turbine rotor 49 in use of the turbine drive and fluid received thereby can flow freely out of the buckets 67 and eventually out of the exhaust apertures 59.

In use of the apparatus, the motive/drive fluid enters the top sub 3 and passes down into the supply passage 44 of the first turbine wheel blade array 58A between the outer casing 41 and stator 42 thereof, whence it is jetted via the nozzles 47 into the chamber 48 in which the rotor 49 is mounted so as to impact in the buckets 67 thereof. The motive fluid is exhausted out of the chamber 48 via the exhaust apertures 59 into the central exhaust passage 59' inside the central tubular member 54 whereupon it is returned radially outwardly via the drive fluid return flow passage 65 to the drive fluid supply passage 44 of the next turbine wheel blade array 58B, whereupon the process is repeated.

With a four stage integrated turbine unit as shown in FIGS. 8 to 12 for use in a 3.125 inch (8 cm) diameter bottom hole assembly and a drive fluid mass flow of 110 US gallons per minute (416 litres per minute) and a supply pressure of 1000 psi (70 kg/cm$^2$) there may be obtained an output of 8200 rpm and 17.4 ft-lbs (2.4 m.kg). With a 12:1 ratio gearing down there can be obtained an output torque of 208.4 ft-lbs (28.8 m.kg) at 683 rpm, which is comparable with the performance of a similarly diametrically sized conventional Moineau motor but of twice the length of a conventional downhole turbine of greater diameter and more than four times the length.

What is claimed is:

1. A turbine suitable for use in down-hole drilling, and comprising a tubular casing enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending inner drive fluid passage generally radially inwardly of said rotor, said casing having a generally axially extending outer drive fluid passage, one of said inner and outer drive fluid passages constituting a drive fluid supply passage and being provided with at least one outlet nozzle formed and arranged for directing at least one jet of drive fluid onto said blade drive fluid receiving faces of said at least one blade array as said blades traverse said nozzle for imparting rotary drive to said rotor, the other constituting a drive fluid exhaust passage and being provided with at least one exhaust aperture for exhausting drive fluid from said at least one turbine wheel blade array.

2. A turbine as claimed in claim 1 wherein said turbine has an array of at least two turbine wheel blade arrays, which array extends longitudinally along the central rotational axis of the turbine, and wherein each one of said turbine wheel blade arrays has associated therewith a respective said outlet nozzle for directing at least one jet of drive fluid onto said blade drive fluid receiving faces of said turbine wheel blade array.

3. A turbine as claimed in claim 2 wherein neighbouring turbine wheel blade arrays are axially spaced apart from each other and provided with drive fluid return flow passages therebetween connecting the exhaust passage of an upstream turbine wheel blade array to the supply passage of a downstream turbine wheel blade array for serial interconnection of said turbine wheel blade arrays.

4. A turbine as claimed in claim 3 wherein each said turbine wheel blade arrays has associated therewith a plurality of angularly distributed outlet nozzles for directing a plurality of jets of drive fluid onto said blade drive fluid receiving faces of said turbine wheel blade array.

5. A turbine as claimed in claim 4 wherein said outlet nozzles are orientated at an angle of from 95 to 70° relative to a radially inward direction.

6. A turbine as claimed in claim 5 wherein said outlet nozzles are orientated tangentially relative to said turbine wheel blade array.

7. A turbine as claimed in claim 5 wherein said exhaust apertures are orientated at an angle of from 95 to 70° relative to radially inward direction.

8. A turbine as claimed in claim 7 wherein said exhaust apertures are orientated tangentially relative to said turbine wheel blade array.

9. A bottom hole assembly comprising at least one turbine according to claim 3, which turbine is drivingly connected to a tool.

10. A bottom hole assembly according to claim 9, wherein said turbine is drivingly connected to said tool via at least one reducing gearbox.

11. A drilling apparatus comprising a drill string, and a bottom hole assembly according to claim 9 wherein the tool comprises a drill bit.

12. A drilling apparatus according to claim 11, wherein said drill string comprises coiled tubing.

13. A turbine as claimed in claim 3 wherein each said turbine wheel blade array has at least 6 turbine blades.

14. A turbine as claimed in claim 3 wherein said turbine blades have an accurate channel section profile.

15. A turbine as claimed in claim 3 wherein each said turbine wheel blade array comprises axially spaced apart radially outwardly extending turbine blade supports for mounting of angularly distributed axially extending turbine blade members providing said turbine blades of each said turbine wheel blade array.

16. A turbine as claimed in claim 3 wherein is provided at least one reducing gearbox and said turbine is drivingly connected to said at least one gearbox.

17. A turbine as claimed in claim 16 wherein said at least one gearbox is an epicyclic gear box.

18. A turbine as claimed in claim 17 wherein said at least one gearbox has a reduction ratio of at least 5:1.

19. A turbine as claimed in claim 3 drivingly coupled with at least one further said turbine.

20. A turbine as claimed in claim 2 wherein said outer drive fluid passage is provided with said outlet nozzles, and said inner drive fluid passage is provided with exhaust apertures.

21. A turbine as claimed in claim 2 wherein said inner drive fluid passage is provided with said outlet nozzles, and said outer drive fluid passage is provided with exhaust apertures.

22. A turbine suitable for use in down-hole drilling, and comprising a tubular casing enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending drive fluid supply passage disposed in a location selected from: radially inwardly of said rotor, and within said casing, and provided with at least one outlet nozzle formed and arranged for directing at least one jet of drive fluid onto said blade drive fluid receiving faces as said blades traverse said at least one nozzle for imparting rotary drive to said rotor, and said chamber having an axial end wall provided with an exhaust aperture for exhausting drive fluid from the turbine.

23. A turbine suitable for use in down-hole drilling, and comprising a tubular casing enclosing a chamber having rotatably mounted therein a rotor comprising at least one turbine wheel blade array with an annular array of angularly distributed blades orientated with drive fluid receiving faces thereof facing generally rearwardly of a forward direction of rotation of the rotor, and a generally axially extending inner drive fluid passage generally radially inwardly of said rotor, said casing having generally axially extending, angularly spaced apart, drive fluid supply and exhaust passages, said drive fluid supply passage being provided with at least one outlet nozzle formed and arranged for directing at least one jet of drive fluid onto said blade drive fluid receiving faces as said blades traverse said nozzle for imparting rotary drive to said rotor, and the drive fluid exhaust passage being provided with an exhaust aperture for exhausting drive fluid from the turbine.

24. A turbine suitable for use in down-hole drilling, and comprising a tubular casing enclosing a chamber having rotatably mounted therein a rotor having at least two turbine wheel blade arrays each with an annular array of angularly distributed blades orientated with drive fluid receiving faces thereof facing generally rearwardly of a forward direction of rotation of the rotor, and a generally axially extending inner drive fluid passage generally radially inwardly of each said turbine wheel blade array, said casing having a respective generally axially extending outer drive fluid passage associated with each said turbine wheel blade array, one of said inner and outer drive fluid passages constituting a drive fluid supply passage and being provided with at least one outlet nozzle formed and arranged for directing at least one jet of drive fluid onto said blade drive fluid receiving faces as said blades traverse said at least one nozzle for imparting rotary drive to said rotor, the other constituting a drive fluid exhaust passage and being provided with at least one exhaust aperture for exhausting drive fluid from said turbine wheel blade arrays, neighbouring turbine wheel blade arrays being axially spaced apart from each other and provided with drive fluid return flow passages therebetween connecting the exhaust passage of an upstream turbine wheel blade array to the supply passage of a ownstream turbine wheel blade array for serial interconnection of said turbine wheel blade arrays.

* * * * *